US006406205B1

(12) United States Patent
Hu

(10) Patent No.: US 6,406,205 B1
(45) Date of Patent: Jun. 18, 2002

(54) PEN HAVING A CONSTANT INK SUPPLYING DEVICE

(75) Inventor: James Hu, Shin-Tien (TW)

(73) Assignee: Pro Eton Corporation, Taipei (TW)

( * ) Notice: Subject to any disclaimer, the term of this patent is extended or adjusted under 35 U.S.C. 154(b) by 0 days.

(21) Appl. No.: 09/843,852

(22) Filed: Apr. 30, 2001

(51) Int. Cl.[7] ..... B43K 5/18
(52) U.S. Cl. ..... 401/205
(58) Field of Search ..... 401/202, 205, 401/230, 232, 235, 264, 196

(56) References Cited

U.S. PATENT DOCUMENTS 2,180,506 A * 11/1939 Burbig
3,459,484 A * 8/1969 Abrams
4,588,319 A * 5/1986 Niemeyer ..... 401/205
4,848,947 A * 7/1989 Kremer et al. ..... 401/264
4,854,758 A * 8/1989 Morel ..... 401/205
5,073,058 A * 12/1991 Fukuoka et al. ..... 401/235
5,332,326 A * 7/1994 Hori ..... 401/264
6,086,279 A * 7/2000 Yen ..... 401/205

* cited by examiner

*Primary Examiner*—Charles R. Eloshway
(74) *Attorney, Agent, or Firm*—Bacon & Thomas

(57) ABSTRACT

In a pen having a constant ink supplying device, the inner wall of the front end of the filler is installed sequentially with a barrel, a plug, a valve, a nib holder and a nib. The plug has a channel for feeding ink through the control of a ball. The front end of the plug is installed with a valve. A cavity for storing ink is installed between the valve and the plug. The nib is inserted into the nib holder. The front end of the filler has a support and an ink inlet. When writing, the nib is pressed and moves so that the support at the front end of the nib holder will push the valve and supply ink to the nib.

12 Claims, 5 Drawing Sheets

PEN HAVING A CONSTANT INK SUPPLYING DEVICE

FIELD OF THE INVENTION

The present invention relates to a pen having a constant ink supplying device. The inner wall of the front end of the filler is installed sequentially with a barrel, a plug, a valve, a nib holder, and a nib. When writing, the nib is pressed, which causes the nib to move and the support at the front end of the nib holder to open the valve and supply ink to the nib.

BACKGROUND OF THE INVENTION

In the prior art, there are two ways for feeding ink in pens. One is to directly supply ink, such as in fountain pens, and the other is by cotton tube. An ink output control is used to control the draining of ink. In the direct supplying type, there is only one valve in the ink output device. It only needs a slight force to press the output device for feeding ink. Since only one valve is used in the output device, the input ink cannot be controlled well. Furthermore, the cotton tube in the pen tube is used to absorb ink, and then by the convection of air, the ink is permeated into the front filler for writing. Since the ink absorbed by the cotton tube is finite, the lifetime of the pen is short and thus it is not economic.

SUMMARY OF THE INVENTION

Accordingly, the primary object of the present invention is to provide a pen having a constant ink supplying device. The inner wall of the front end of the filter is installed sequentially with a barrel, a plug, a valve, a nib holder, and a nib. The cavity at the rear end of the barrel has a larger volume so as to contain more ink. When writing, since the nib is pressed, the nib moves relative to the barrel, which causes the support at the front end of the nib holder to open the valve so as to supply ink to the nib. When not writing, the valve will close so as to stop the supply of ink to the filler. The whole structure is simplified and the ink supply can be controlled effectively.

The various objects and advantages of the present invention will be more readily understood from the following detailed description when read in conjunction with the appended drawing.

DETAILED DESCRIPTION OF THE INVENTION

In order that those skilled in the art can further understand the present invention, a preferred embodiment will be described in detail. However, the description and the appended drawings are only to be used to cause those skilled in the art to understand the objects, features, and characteristics of the present invention, and not to limit the scope and spirit of the present invention, which is defined in the appended claims.

Figure 1:
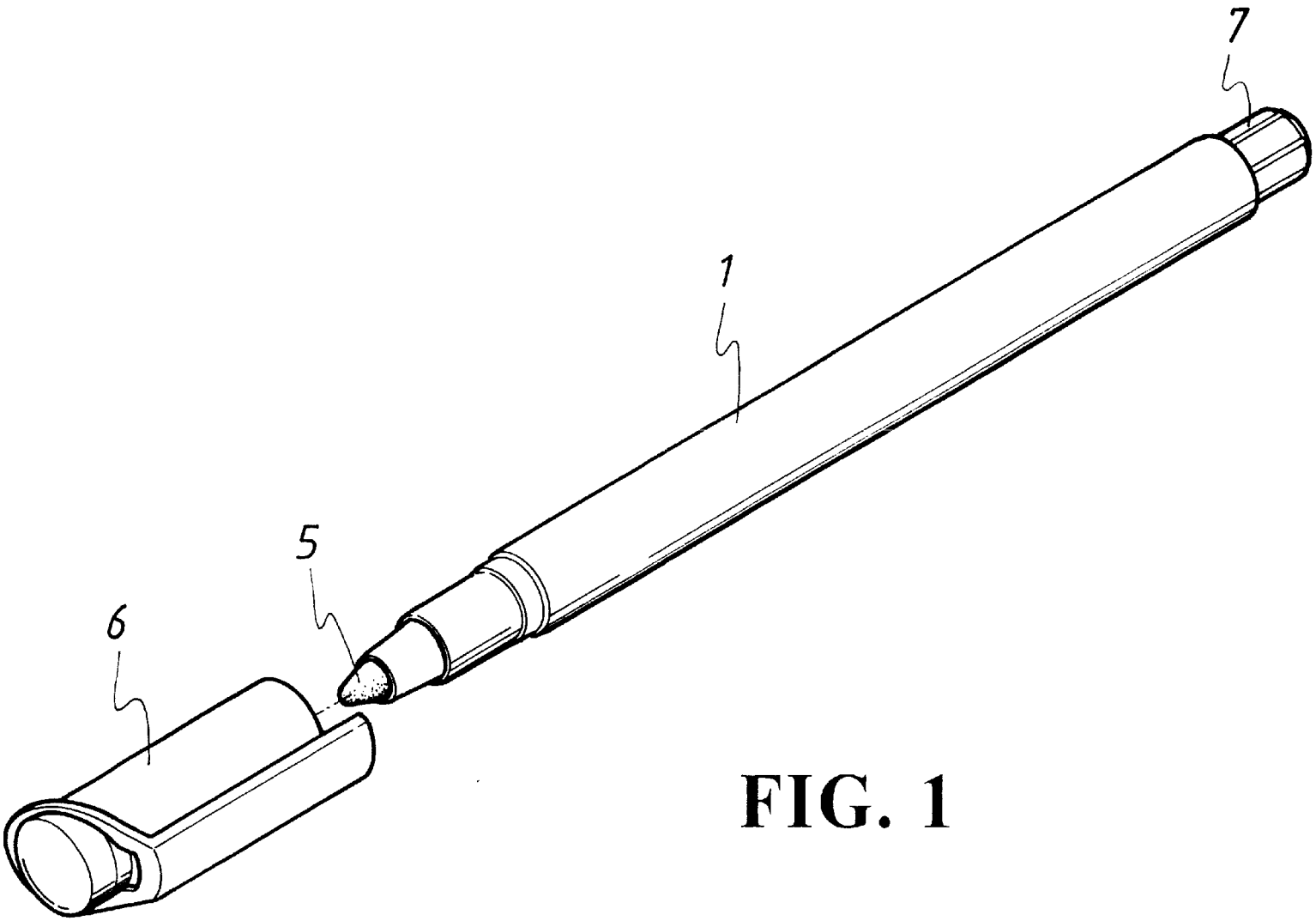
FIG. 1 is a schematic perspective view of the present invention.
Figure 2:
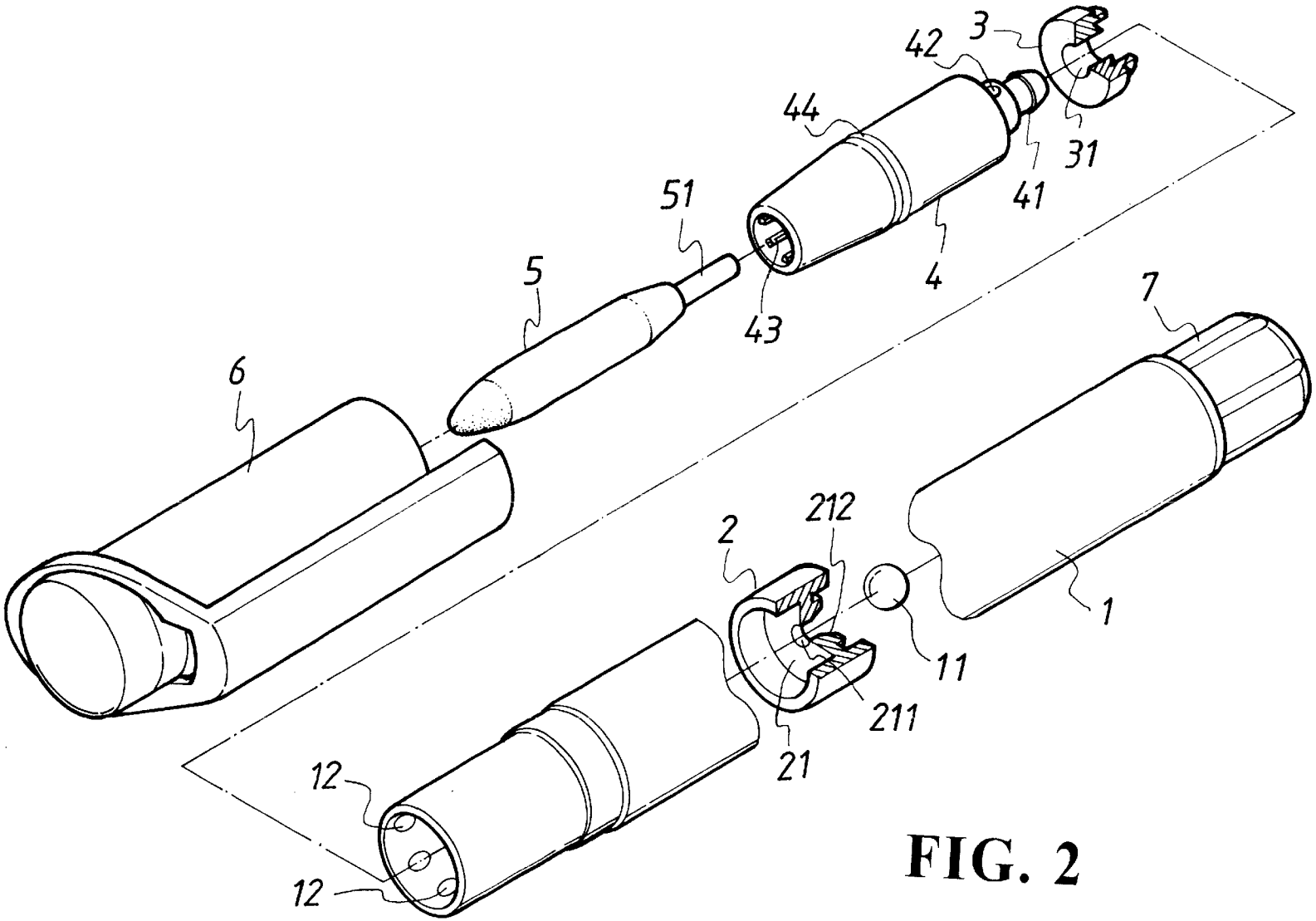
FIG. 2 is an exploded perspective view of the present invention.
Figure 3:
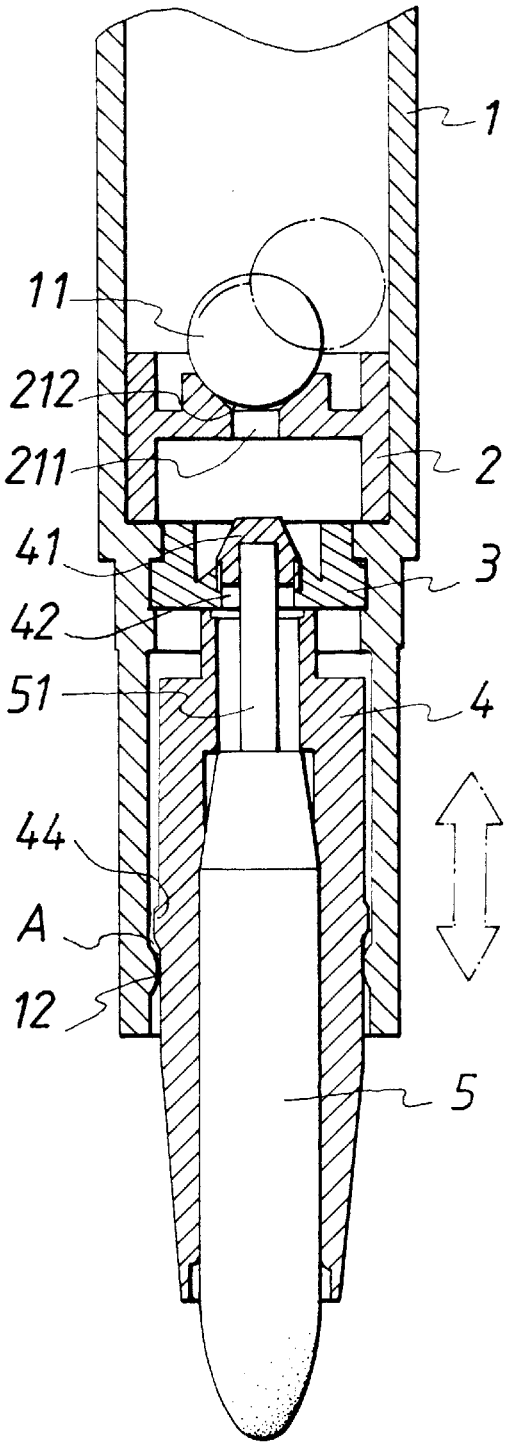
FIG. 3 is a partial assembly cross sectional view showing that the valve of the present invention is closed as the pen is not used.

Referring to FIGS. 1 to 3, the pen of the present invention is illustrated. The ink feeding device of the present invention includes a barrel 1, a plug 2, a valve 3, a nib holder 4, a nib 5, and other elements as described below.

The barrel 1 is to be filled with ink, and has a ball 11 therein, the front end of the inner wall is sequentially installed with the plug 2, a valve 3, a nib holder 4, and a filler 5. The front end of the pen body is engaged with a cap 6, and the rear end thereof is sealed by a stud (the rear end of the pen can be sealed integrally).

The plug 2 has a spacer 21 at the center portion and is an annular body with a longitudinal cross section like an H. The spacer 21 is installed with a channel 211. One end of the channel 211 has a bowl-like node depression 212 so that ball 11 can easily slide therein to so as to isolate the channel 211. Another end of the channel is installed with a cavity 22.

The valve 3 is made of flexible material (such as silicon glue or rubber, etc.) and is firmly secured to the lower end of the plug 2. A central hole 31 is formed.

A nib holder 4 is movably installed below the valve 3. The front end of the nib holder 4 has a stepped support 41 and an ink inlet 42. Normally, the support 41 rests against the lower side of the central hole 31 of the valve 3, and the valve 3 exactly isolates the ink inlet 42. The ink in the cavity 22 will not flow into the nib holder 4. The engaging inner wall of the nib holder 4 engaged with the nib 5 is installed with a plurality of adjacent long ribs 43 so that as the nib 5 is inserted into the nib holder 4, it can be tightly retained.

The nib 5 is an ink absorber and is installed in the inner wall of a joining end of the nib holder 4 and communicates with the ink inlet 42 of the nib holder 4.

The upper end of the nib 5 includes a step-like ink feeder 51. The ink feeder 51 may be inserted into the support 41 of the nib holder 4 to be retained therein.

The barrel 1 has a front end tube wall and is installed with projections 12 (or straight ribs), while the outer wall of the nib holder 4 is installed with an annular rib 33 so that the nib holder 4 is retained by the projections 12. The annular rib 44 retains a slight gap A with respect to the tube wall of the pen tube 1 so that external air flows into the slight gap A to enter into the ink feeding device.

Figure 4:
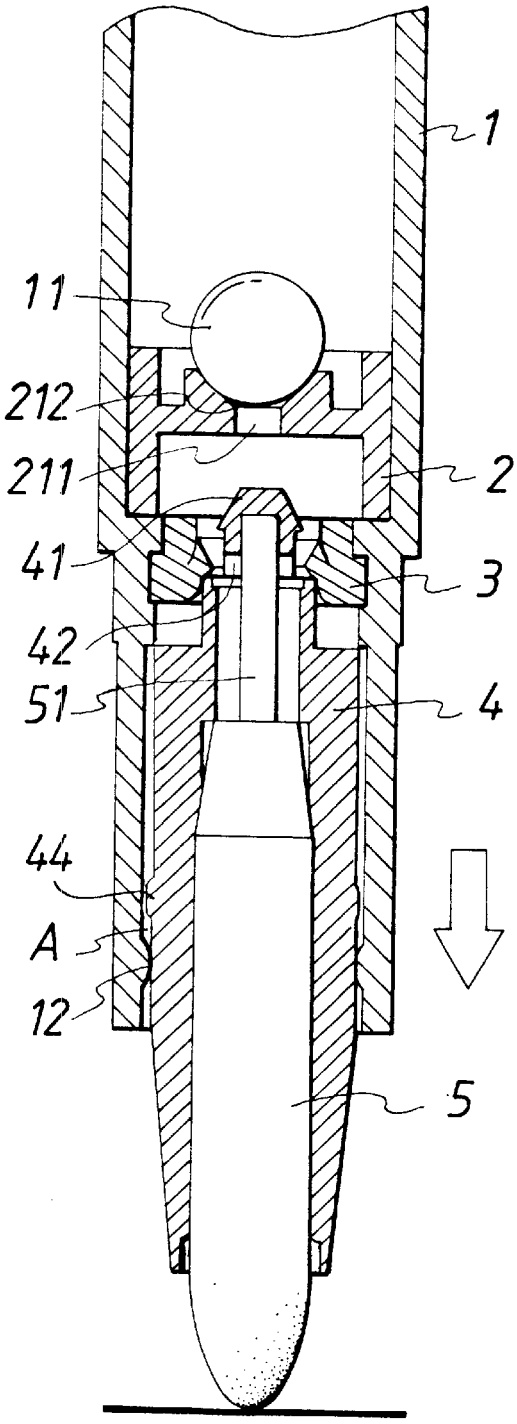
FIG. 4 is a partial assembly cross sectional view showing that the valve of the present invention is opened as the pen is used.
Figure 5:
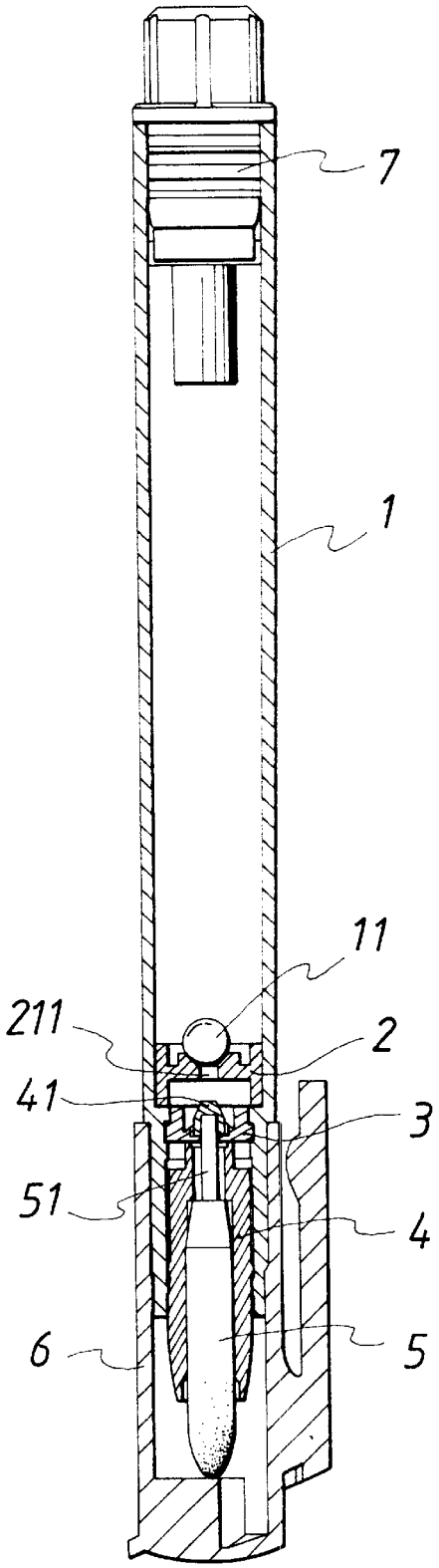
FIG. 5 is an assembled cross sectional view of the present invention.

In the above components, by shaking the barrel 1, the ball 11 controls access to the channel 211 so that ink flows into the cavity 22. Therefore, when the pen is not used, the valve 3 will close so that the ink of the cavity 22 is completely isolated from the nib holder 4. However, in writing, since the pen body is straight, the ball 11 will drop into the cavity and then isolates the channel 211 of the plug 2 so that the hydraulic pressure applied to the nib holder 4 may be released. Further, the nib 5 moves inwards so that the support 41 at the front end of the nib holder 4 will push the valve 3 to open (i.e., as illustrated in FIG. 4, the support 41 disengages from valve 3) so as to achieve the object of supplying ink to the nib and preventing ink from draining out. However, when the ink in the cavity 22 is exhausted, the tube 1 can be shaken slightly, thereby causing the ball 11 to separate from the bowl-like groove 212 so that the ink flows into cavity 22 again. Therefore, the object of supplying ink into the cavity is achieved.

The aforesaid ink feeding device has a simple structure and components. Thus, the manufacturing and assembly work are easy. All the components are concentrated at the inner wall of the front end of the barrel so that the ink at the inner wall of the rear end of the barrel 1 has a larger space for storing in.

Figure 6:
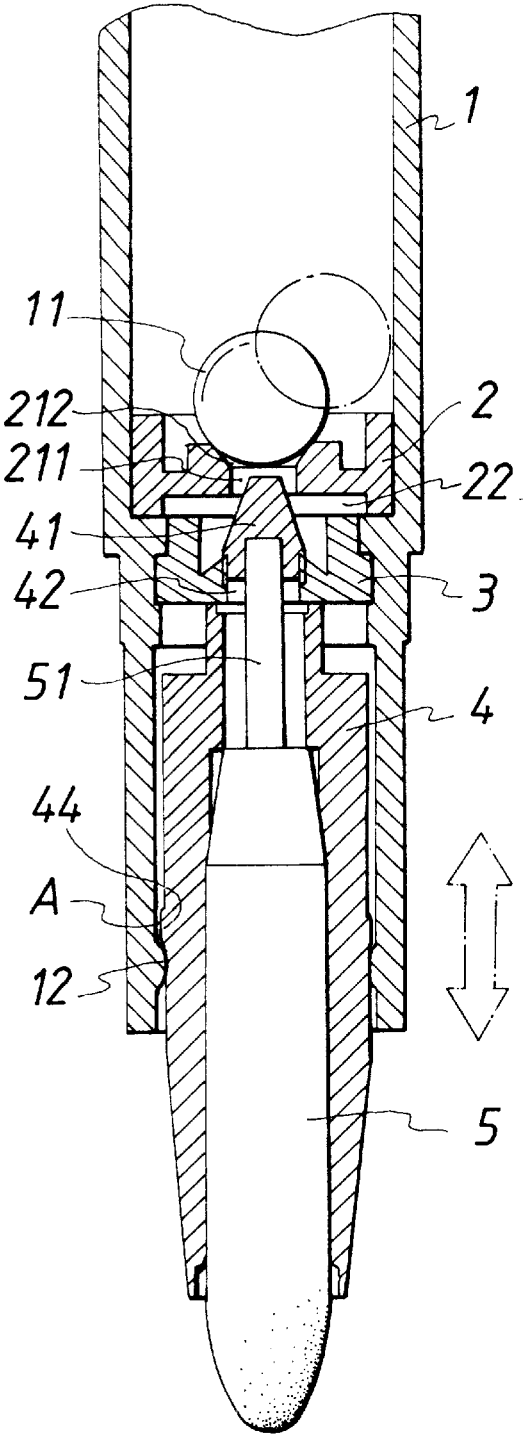
FIG. 6 is a partial assembly cross sectional view showing that in another embodiment, the valve and the plug of the present invention is closed as the pen is not used.
Figure 7:
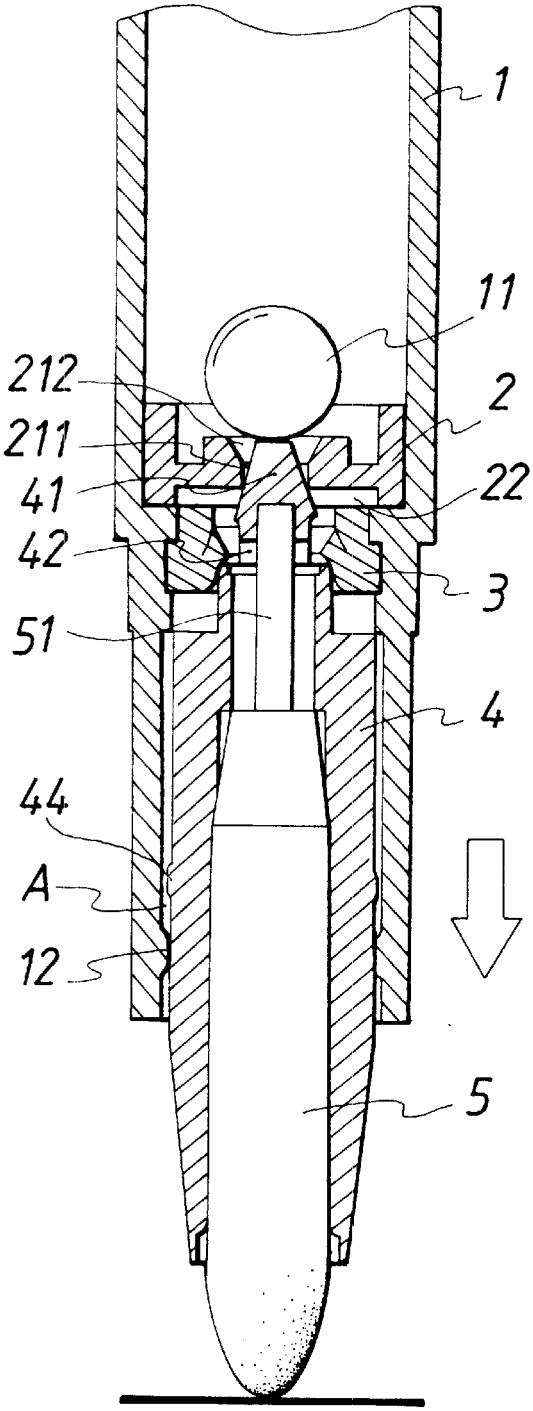
FIG. 7 is a partial assembly cross sectional view showing that in another embodiment, the valve and the channel of the plug of the present invention is opened as the pen is used.

According to the spirit of the present invention, as shown in the FIGS. 6 and 7, the cavity 22 can be reduced further (or the total length of the plug 2 can be properly shortened). In this variation, the support 41 at the upper end of the nib holder 4 is retained by the holder 4 in the barrel 1, but can enter channel 211 and push out ball 11 so that the ink flows continuously into the nib holder 4 from the channel 211 of the plug 2, and so that the nib 5 may be supplied with ink continuously.

Despite the present invention having been described in detail, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A pen having a constant ink supplying device, comprising a barrel, a plug, a valve, a nib holder, and a nib, wherein the barrel is arranged to be filled with ink and contains a ball, said plug, valve, nib holder, and nib being sequentially installed in a front end of an inner wall of the barrel, the plug is an annular body having a channel, said ball being arranged on one side of said plug to control flow of ink from said barrel to said channel, and an opposite side of the plug forming a cavity for storing ink that has passed through said channel from said barrel, the valve is made of a flexible material and is firmly secured to a lower end of said plug, said valve including a central opening, the nib holder is movably installed below the valve, an upper end of the nib holder including a support and an ink inlet, said support being arranged to engage said valve and prevent ink from flowing through said central opening to said ink inlet, and the nib is an ink absorber installed within the nib holder in communication with the ink inlet of the nib holder, and wherein when said barrel is shaken, said ball moves away from the channel allowing ink to flow from said barrel through said channel to said cavity, said ink being prevented from flowing to said nib by said valve, wherein when said pen is in an upright position, said ball closes said channel and hydraulic pressure is applied to said nib holder, and wherein during writing, pressure on said nib moves said support and causes said valve to open, thereby permitting said ink to flow from said cavity through said central opening and said ink inlet to said nib.

2. The pen having a constant ink supplying device as claimed in claim 1, wherein a front end of a pen body of said barrel engages a cap.

3. The pen having a constant ink supplying device as claimed in claim 2, wherein a rear end of the pen body is sealed.

4. The pen having a constant ink supplying device as claimed in claim 1, wherein a front end of the nib includes a step-like ink feeder, said ink feeder being inserted into and retained by the support.

5. The pen having a constant ink supplying device as claimed in claim 1, wherein the plug includes an annular body having a longitudinal H-shaped cross-section, a middle portion of the annular body including a spacer.

6. The pen having a constant ink supplying device as claimed in claim 1, wherein said channel of the plug has a bowl-shaped depression at said one side for receiving said ball.

7. The pen having a constant ink supplying device as claimed in claim 1, wherein said valve is made of a flexible material selected from the group consisting of silicon glue and rubber.

8. The pen having a constant ink supplying device as claimed in claim 1, wherein said support is step-shaped.

9. The pen having a constant ink supplying device as claimed in claim 1, wherein an engaging inner wall of the nib holder that engages the nib includes a plurality of ribs arranged to retain the nib in the nib holder.

10. The pen having a constant ink supplying device as claimed in claim 1, wherein a front end tube wall of the barrel includes projections, and wherein an outer wall of the nib holder includes an annular rib, said projections and annular rib cooperating to retain said nib holder within said barrel.

11. The pen having a constant ink supplying device as claimed in claim 10, wherein a slight gap is present between said annular rib and the tube wall of the barrel so that external air enters the ink feeding device through the gap.

12. The pen having a constant ink supplying device as claimed in claim 1, wherein said support extends through said channel to engage said ball and maintain a continuous flow of ink to the nib.

* * * * *